US006426167B2

(12) United States Patent
Yau et al.

(10) Patent No.: US 6,426,167 B2
(45) **Date of Patent: *Jul. 30, 2002**

(54) WATER-RESISTANT PROTECTIVE OVERCOAT FOR IMAGE RECORDING MATERIALS

(75) Inventors: Hwei-Ling Yau, Rochester; Lan B. Thai, Penfield; Jin-Shan Wang, Rochester; Tienteh Chen, Penfield, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/353,939

(22) Filed: Jul. 15, 1999

(51) Int. Cl.[7] ..... G03C 11/08; G03C 11/06; G03C 1/76; B41J 2/01

(52) U.S. Cl. ..... 430/14; 430/350; 430/537; 430/961; 430/527; 347/105

(58) Field of Search ..... 430/537, 350, 430/961, 536, 527, 273.1; 347/105

(56) References Cited

U.S. PATENT DOCUMENTS

| | | | | |
|---|---|---|---|---|
| 2,173,480 A | | 9/1939 | Jung | |
| 2,259,009 A | | 10/1941 | Talbot | |
| 2,331,746 A | | 10/1943 | Talbot | |
| 2,706,686 A | | 4/1955 | Hilborn | 430/350 |
| 2,798,004 A | | 7/1957 | Weigel | |
| 3,113,867 A | | 12/1963 | Van Norman et al. | |
| 3,190,197 A | | 6/1965 | Pinder | |
| 3,397,980 A | | 8/1968 | Stone | |
| 3,415,670 A | | 12/1968 | McDonald | |
| 3,697,277 A | | 10/1972 | King | |
| 4,092,173 A | | 5/1978 | Novak et al. | |
| 4,171,979 A | | 10/1979 | Novak et al. | |
| 4,279,945 A | | 7/1981 | Audran et al. | 430/140 |
| 4,302,523 A | | 11/1981 | Audran et al. | 430/523 |
| 4,333,998 A | | 6/1982 | Leszyk | 430/961 |
| 4,426,431 A | | 1/1984 | Harasta et al. | 430/961 |
| 4,459,601 A | | 7/1984 | Howkins | 346/140 R |
| 4,490,728 A | | 12/1984 | Vaught et al. | 346/1.1 |
| 4,554,235 A | * | 11/1985 | Adair et al. | 430/138 |
| 4,723,129 A | | 2/1988 | Endo et al. | 346/1.1 |
| 4,954,395 A | | 9/1990 | Hasegawa et al. | 346/135.1 |
| 4,999,266 A | | 3/1991 | Platzer et al. | 430/96 |
| 5,066,572 A | * | 11/1991 | O'Connor et al. | 430/961 |
| 5,179,147 A | | 1/1993 | Jones | 524/261 |
| 5,330,885 A | * | 7/1994 | Takamuki et al. | 430/961 |
| 5,447,832 A | | 9/1995 | Wang et al. | 430/523 |
| 5,560,770 A | | 10/1996 | Yatake | 106/22 |
| 5,563,634 A | | 10/1996 | Fujii et al. | 347/54 |
| 5,571,850 A | | 11/1996 | Ma et al. | 523/160 |
| 5,681,688 A | | 10/1997 | Takamuki | 430/537 |
| 5,725,961 A | | 3/1998 | Ozawa et al. | 347/105 |
| 5,770,353 A | * | 6/1998 | Wang et al. | 430/961 |
| 5,853,926 A | | 12/1998 | Bohan et al. | 430/350 |
| 5,853,965 A | | 12/1998 | Haydock et al. | 430/536 |
| 5,856,051 A | | 1/1999 | Yau et al. | 430/537 |
| 5,866,282 A | | 2/1999 | Bourdelais et al. | 430/536 |
| 5,866,312 A | * | 2/1999 | Wang et al. | 430/961 |

(List continued on next page.)

FOREIGN PATENT DOCUMENTS

| | | | |
|---|---|---|---|
| EP | 587390 | * | 3/1994 |
| EP | 0 613 047 A | | 8/1994 |
| EP | 0 620 481 A | | 10/1994 |
| EP | 0 858 905 | | 8/1998 |

OTHER PUBLICATIONS

H. P. Le, Progress and Trends I nInk–Jet Printing Technology.

W.E. Lee and E.R. Brown, The Developing Agents And Their Reactions, The Theory Of Photographic Process, 1977, pp. 291–327.

Research Disclosure No. 37038, Feb. 1995, Typical And Preferred Colored Paper, Color Negative, And Color Reversal Photographic Elements and Processing.

Research Disclosure No. 34390, Nov. 1992, Photographic Light–Sensitive Silver Halide Film Can Comprise A Transparent Magnetic Recording Layer, Usually Provided On The Backside Of The Photographic Support.

Japanese Patents Abstracts 02 259636 A Oct. 1990.

*Primary Examiner*—Richard L. Schilling
(74) *Attorney, Agent, or Firm*—Chris P. Konkol

(57) ABSTRACT

An overcoat composition for imaging products containing: 30–95 weight %, based on the dry laydown of the overcoat, of a hydrophobic polymer, said hydrophobic polymer being homopolymers or copolymers containing at least 30% by weight, based on the total weight of monomers, of the monomer described in structurel; and 5 to 70 weight %, based on the dry laydown of the overcoat, of gelatin:

Structure 1 wherein:

R is H, $CH_3$, $C_2H_5$, and $C_3H_7$; and $X_1$, $X_2$, $X_3$, $X_4$ and $X_5$ are H, F, Cl, Br, I, CN, $CH_3O$, $C_2H_5O$, $C_3H_7O$, $C_4H_9O$, $CH_3$, $C_2H_5$, $C_3H_7$, n-$C_4H_9$, sec-$C_4H_9$, tert-$C_4H_9$, $CF_3$, $C_2F_5$, $C_3F_7$, iso-$C_3F_7$, n-$C_4F_9$, sec-$C_4F_9$, tert-$C_4F_9$, $CH_3NH$, $(CH_3)_2N$, n-$C_5H_{11}$, $C_4H_9$, n-$C_6H_{13}$, n-$C_7H_{15}$, n-$C_8H_{17}$, n-$C_9H_{19}$, n-$C_{10}H_{21}$, or n-$C_{12}H_{25}$.

6 Claims, No Drawings

U.S. PATENT DOCUMENTS

| | | | | |
|---|---|---|---|---|
| 5,874,205 | A | | 2/1999 | Bourdelais et al. ..... 430/536 |
| 5,888,643 | A | | 3/1999 | Aylward et al. ..... 430/536 |
| 5,888,681 | A | | 3/1999 | Gula et al. ..... 430/536 |
| 5,888,683 | A | | 3/1999 | Gula et al. ..... 430/536 |
| 5,888,714 | A | | 3/1999 | Bourdelais et al. ..... 430/536 |
| 5,958,658 | A | * | 9/1999 | Smith et al. ..... 430/961 |
| 6,043,010 | A | * | 3/2000 | Hokazono et al. ..... 430/961 |
| 6,210,844 | B1 | * | 4/2001 | Sondergeld ..... 430/961 |

* cited by examiner

WATER-RESISTANT PROTECTIVE OVERCOAT FOR IMAGE RECORDING MATERIALS

CROSS REFERENCE TO RELATED APPLICATIONS

The present invention is related to commonly owned U.S. applications filed on even date herewith: U.S. Ser. No. 09/354,055 of Yau et al., titled OVERCOAT MATERIAL AS PROTECTING LAYER FOR IMAGE RECORDING MATERIALS, U.S. Ser. No. 09/354,209 of Yau et al., titled PROTECTING LAYER FOR IMAGE RECORDING MATERIALS and U.S. Ser. No. 09/354,556 of PROTECTING LAYER FOR GELATIN BASED PHOTOGRAPHIC PRODUCTS CONTAINING 1H-PYRAZOLO[1,5-b][1,2,4]TRIAZOLE-TYPE MAGENTA COUPLER.

FIELD OF THE INVENTION

The present invention relates to image recording materials. More particularly the present invention provides a protective overcoat which provides excellent scratch and spill resistance to image recording materials.

BACKGROUND OF THE INVENTION

Gelatin has been used extensively in a variety of image recording systems as the binder for its many unique properties. For example, its water-swellable property allows processing chemistry to be carried out to form silver halide-based photographic images, and its hydrophilic nature allows gelatin to function as an ink-receiver in ink-jet printing systems. However, due to this same property, recorded images, no matter if they are formed on transparent or reflective media, have to be handled with extreme care so as to not be in contact with any aqueous solutions to damage the images.

There have been attempts over the years to provide protective layers for gelatin-based photographic systems that will protect the images from damage by water or any aqueous solution. For example, U.S. Pat. No. 2,173,480 describes a method of applying a colloidal suspension to moist film as the last step of photographic processing before drying. A series of patents describe the methods of solvent-coating a protective layer on the image after photographic processing was completed. See, for example, U.S. Pat. Nos. 2,259,009, 2,331,746, 2,798,004, 3,113,867, 3,190,197, 3,415,670 and 3,733,293. There is also teaching describing the application of UV-polymerizable monomers and oligomers on processed images followed by radiation exposure to form a crosslinked protective layer. Radiation curable layers are exemplified in U.S. Pat. Nos. 4,092,173, 4,171,979, 4,333,998, and 4,426,431.

The obvious drawback for the solvent coating method and radiation cure method is the health and environmental concern of those chemicals to the coating operator. U.S. Pat. Nos. 3,397,980, 3,697,277 and 4,999,266 describe the method of laminating polymeric sheet film on the processed image as the protective layer. U.S. Pat. No. 5,447,832 describes the use of a protective layer containing a mixture of high and low Tg latices as the water-resistant layer to preserve the anti-static property of the $V_2O_5$ layer through photographic processing. This protective layer is not applicable to the image formation layers since it will detrimentally inhibit the photographic processing. U.S. Pat. No. 2,706,686 describes the use of a lacquer layer containing inorganic compound $NH_4HCO_3$ particles in the overcoat, followed by sublimation or dissolving of such compound in photographic processing and heat fusing to obtain a water resistant layer. However, the lacquer overcoat was applied as a suspension in an organic solvent and the volatiles or salts released from $NH_4HCO_3$ were major disadvantages in manufacturing as well as to photoprocessing laboratories. In addition, there are many patents disclosing overcoat formulations to improve scratch resistance of dry gelatin coatings, such as U.S. Pat. No. 5,179,147 among many others. However these overcoat formulations do not impart water resistance.

In general, all methods of protection requiring the application or coating of a layer after image formation suffer from the drawbacks of additional cost, the need for modifications to the processing equipment and additional operator training.

U.S. Pat. No. 5,853,926 describes the application of an aqueous coating comprising polymer particles in a polymer latex binder, allowing for development of a photographic image and after processing, fusing by heat to form a protective surface. The disadvantages of such a method include the limited photographic processing rates achievable when a polymer latex binder is used in the protective layer.

European Patent Application 0,858,905A1 describes a porous, particulate outermost layer applied to ink-jet recording media, that is heat-fused after ink absorption to form a protective surface. Such porous surface layers are often mechanically weak and in particular can be prone to scratching damage or material removal during transport and handling prior to image formation and subsequent fusing, thus compromising the usefulness of their protective function.

U.S. Pat. No. 5,856,051 describes the use of hydrophobic particles with gelatin as the binder in the overcoat formulation. This invention demonstrated an aqueous coatable, water-resistant protective overcoat that can be incorporated into the photographic product, allows for appropriate diffusion of photographic processing solutions, and does not require a coating operation after exposure and processing. The hydrophobic polymers exemplified in U.S. Pat. No. 5,856,051 include polyethylenes having a melting temperature (Tm) of 55 to 200° C., and therefore capable of forming a water-resistant layer by fusing the layer at a temperature higher than the Tm of the polymer after the sample has been processed to generate the image. The coating solution is aqueous and can be incorporated in the manufacturing coating operation without any equipment modification. The fusing step is simple and environmentally friendly to photofinishing laboratories. Since the particles are incorporated entirely within the uppermost layer, this approach does not suffer from a lack of mechanical strength and integrity during transport and handling prior to image formation and fusing. However, the scratch resistance of such an overcoat after fusing is a serious concern, since polyethylene is a very soft material.

Thus, there remains a need for an aqueous coatable, water-resistant protective overcoat that can be incorporated into the image recording material during manufacturing, that is not damaged during machine transport and handling, that allows for appropriate diffusion of photographic processing solutions or uptake of ink, that does not require a coating operation after exposure and processing and that offers good scratch resistance.

SUMMARY OF THE INVENTION

The present invention provides an aqueous-coatable protective overcoat that can be coated on to the image recording material (either sequentially or simultaneously), allows for appropriate diffusion of photographic processing solutions or uptake of ink, and can be fused after photographic processing or ink-jet printing to form a water-resistant protective overcoat with good scratch resistance.

The present invention describes an uppermost-layer or overcoat composition that can be incorporated and coated directly in the image recording material during manufacturing, that does not inhibit photographic processing or uptake of ink, and that can become water-resistant by fusing the layer after it goes through photographic processing or ink-jet printing. A component of the invention is the hydrophobic polymer particles of polystyrene-type homo- or co-polymers consisting of at least 30% styrene-type monomers. The polymer can be either liner, graft or hyperbranched. The material of the invention can be introduced to the overcoat coating melt in a latex form or as a conventional colloidal dispersion in gelatin. When used at 50–70% by weight, based on total laydown of the overcoat where gelatin is the binder, it allows photographic processing to proceed at an acceptable rate. After processing to obtain images, the image recording media can be fused at a temperature above 300° F. to form a water-resistant surface. Compared to U.S. Pat. No. 5,856,051 which describes the use of commercially available polyethylene particles, the polystyrene particles of the present invention offer improved dry scratch resistance.

Hence, the present invention provides:

An overcoat composition for image recording elements comprising:

30 to 95 weight percent, based on the dry laydown of the overcoat, of hydrophobic polymer particles having an average size of 0.01 to 0.5 micrometers, said hydrophobic polymer being a homopolymer of the monomer described in Structure 1 or a copolymer containing at least 30 weight percent, based on the total weight of monomers, of the monomer described in Structure 1 and 5 to 70 weight percent of gelatin, based on the dry laydown of the overcoat:

Structure 1

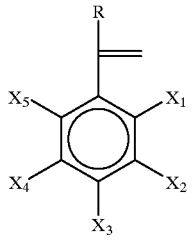

wherein:

R is H, $CH_3$, $C_2H_5$, and $C_3H_7$; and $X_1$, $X_2$, $X_3$, $X_4$ and $X_5$ are H, F, Cl, Br, I, CN, $CH_3O$, $C_2H_5O$, $C_3H_7O$, $C_4H_9O$, $CH_3$, $C_2H_5$, $C_3H_7$, n-$C_4H_9$, sec-$C_4H_9$, tert-$C_4H_9$, $CF_3$, $C_2F_5$, $C_3F_7$, iso-$C_3F_7$, n-$C_4F_9$, sec-$C_4F_9$, tert-$C_4F_9$, $CH_3NH$, $(CH_3)_2N$, n-$C_5H_{11}$, $C_4H_9$, n-$C_6H_{13}$, n-$C_7H_{15}$, n-$C_8H_{17}$, n-$C_9H_{19}$, n-$C_{10}H_{21}$, or n-$C_{12}H_{25}$.

Another aspect of the invention provides:

An imaging element comprising:

a support;

at least one image recording layer; and an outer layer overlying the at least one image recording layer, the outer layer comprising the composition described above.

DETAILED DESCRIPTION OF THE INVENTION

The present invention provides a novel overcoat formulation for the image recording side of image recording materials, particularly photographic prints, which encounter frequent handling and abuse by end users. The overcoat formulation of this invention comprises 30 to 95% by weight (based on the dry laydown of the overcoat) of hydrophobic polymer particles of 0.01 to 0.5 micrometers in average size and 5 to 70% by weight (based on the dry laydown of the overcoat) of gelatin as binder. Other common addenda, such as hardeners, spreading agents, charge control agents, dry scratch resistance compounds and lubricants can also be included in the formulation as needed. The hydrophobic polymer of this invention are homopolymers or copolymers containing at least 30% by weight of monomer described in Structure (1).

Structure 1

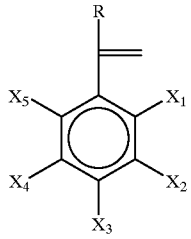

wherein:

R is H, $CH_3$, $C_2H_5$, or $C_3H_7$; and $X_1$, $X_2$, $X_3$, $X_4$ and $X_5$ are H, F, Cl, Br, I, CN, $CH_3O$, $C_2H_5O$, $C_3H_7O$, $C_4H_9O$, $CH_3$, $C_2H_5$, $C_3H_7$, n-$C_4H_9$, sec-$C_4H_9$, tert-$C_4H_9$, $CF_3$, $C_2F_5$, $C_3F_7$, iso-$C_3F_7$, n-$C_4F_9$, sec-$C_4F_9$, tert-$C_4F_9$, $CH_3NH$, $(CH_3)_2N$, n-$C_5H_{11}$, $C_4H_9$, n-$C_6H_{13}$, n-$C_7H_{15}$, n-$C_8H_{17}$, n-$C_9H_{19}$, n-$C_{10}H_{21}$, or n-$C_{12}H_{25}$.

The polymer architecture can be linear, block, dendritic, hyperbranched or grafted. The comonomers that can be included in the polymer composition are ethylene, propylene, 1-butene, sodium vinylbenzenesulfonate, potassium vinylbenzylsulfonate, sodium vinylsulfonate; and mono-ethylenic unsaturated esters of fatty acids (such as vinyl acetate, allyl acetate), monoethylenic unsaturated amides of fatty acids (such as N-vinylacetamide, N-vinylpyrrolidone), ethylenically unsaturated monocarboxylic acid or dicarboxylic acid esters (such as methyl acrylate, ethyl acrylate, hydroxyethyl acrylate, methyl methacrylate, n-butyl methacrylate, t-butyl methacrylate, benzyl acrylate, 2-ethylhexyl acrylate, cyclohexyl methacrylate, tetrafurfuryl acrylate, isobomyl methacrylate, isobomylacrylate, allylmethacrylate, bisphenol-A dimethacrylate, bromophenyl methacrylate, cyanoethyl methacrylate, glycidyl methacrylate, 1-fluoromethyl methacrylate, 2-fluoroethyl methacrylate, heptadecafluorodecyl methacrylate, heptafluorobutyl methacrylate, hexadecafluorononyl methacrylate, hexafluoro bisphenol-A methacrylate, isocyanatoethyl methacrylate, norbornyl methacrylate, pentachlorophenyl methacrylate, pentaflurobenzyl methacrylate, perfluorooctyl methacrylate, 4-tert-butylcyclohexyl methacrylate, p-tert-butylphenyl methacrylate, trifluroethyl methacrylate, diethyl maleate, diethyl itaconate, ethylenically unsaturated monocarboxylic acid amides (such as acrylamide, dimethyl-acrylamide, methacrylamide, diacetoneacrylamide, acryloylmorpholine, sodium acrylamide-2-methylpropanesulfonate, methacryloylmorpholine), mono-ethylenically unsaturated compounds (such as acrylonitrile, methacrylonitrile, tetrafluroethylene, vinyl chloride, vinylidene chloride, vinylidene fluoride, vinyl fluoride) and dienes (such as butadiene, isoprene), and in particular, highly hydrophobic compounds are especially preferred among them.

The polymer can be prepared by emulsion polymerization, solution polymerization, suspension polymerization, dispersion polymerization, ionic polymerization (cationic, anionic), Atomic Transfer Radical Polymerization, and other polymerization methods known in the art of polymerization. Most desirable methods are emulsion polymerization and suspension polymerization. If the polymer is prepared by an alternative method, the polymer dispersion can be prepared with a shearing device (such as colloid mill, microfluidizer or other homogenizer) in the presence of gelatin and surfactant.

A water-resistant layer can be formed by fusing the image recording material at a temperature higher than 300° F. after the photographic material has been processed to generate an image or the ink-jet image has been formed. The presence of 5–70% by weight of gelatin is sufficient to allow proper permeability for processing solution to diffuse in and out for image development, or for ink to be received by the ink-jet receiving layer. The coating solution is aqueous and can be incorporated in the manufacturing coating operation without any equipment modification. The fusing step is simple and environmentally friendly to photofinishing laboratories.

The image recording elements protected in accordance with this invention can be derived from silver halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion picture prints or they can be imaged elements that are viewed by reflection, such as paper prints. Because of the amount of handling that can occur with paper prints and motion picture prints, they are preferred imaged photographic elements for use in this invention.

The photographic elements in which the images to be protected are formed can have the structures and components shown in Research Disclosure 37038. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent (for example, a film support) or reflective (for example, a paper support). Support bases that can be used include both transparent bases, such as those prepared from polyethylene terephthalate, polyethylene naphthalate, cellulosics, such as cellulose acetate, cellulose diacetate, cellulose triacetate, and reflective bases such as paper, coated papers, melt-extrusion-coated paper, and laminated papers, such as those described in U.S. Pat. Nos. 5,853,965; 5,866,282; 5,874,205; 5,888,643; 5,888,681; 5,888,683; and 5,888,714. Photographic elements protected in accordance with the present invention may also include a magnetic recording material as described in *Research Disclosure*, Item 34390, November 1992, or a transparent magnetic recording layer such as a layer containing magnetic particles on the underside of a transparent support as described in U.S. Pat. Nos. 4,279,945 and 4,302,523.

Suitable silver halide emulsions and their preparation, as well as methods of chemical and spectral sensitization, are described in Sections I through V of Research Disclosure 37038. Color materials and development modifiers are described in Sections V through XX of Research Disclosure 37038. Vehicles are described in Section II of Research Disclosure 37038, and various additives such as brighteners, antifoggants, stabilizers, light absorbing and scattering materials, hardeners, coating aids, plasticizers, lubricants and matting agents are described in Sections VI through X and XI through XIV of Research Disclosure 37038. Processing methods and agents are described in Sections XIX and XX of Research Disclosure 37038, and methods of exposure are described in Section XVI of Research Disclosure 37038.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element or color paper element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

Image recording elements in which the images to be protected are formed may also be produced using ink-jet printing. This printing technology is reviewed in an article titled "Progress and Trends in Ink-Jet Printing Technology" by Hue P. Le in the Journal of Imaging Science and Technology, Volume 42, Number 1 (January/February 1998), pp. 49–61. Essentially, ink droplets, typically in the volume range 1–100 picoliters, are ejected from a printhead to a receiver material on which the image is formed. The ink-jet printhead may be of the continuous or drop-on-demand varieties. Several physical mechanisms for drop ejection are known, but the currently most popular among these are thermal and piezoelectric. In the thermal mechanism, ink in the printhead is heated to form a water vapor bubble that expels one or more ink droplets out of the printhead toward the receiver. Representative thermal ink-jet printheads are described in, for example, U.S. Pat. No. 4,723,129 of Endo et al. (Canon) and U.S. Pat. No. 4,490,728 of Vaught et al. (Hewlett Packard). In the piezoelectric mechanism, one or more droplets are expelled from the printhead by a physical deformation that accompanies a voltage change across a piezoelectric material forming a part of the printhead structure. Representative piezoelectric printheads are described in, for example, U.S. Pat. No. 4,459,601 of Howkins (Exxon) and U.S. Pat. No. 5,563,634 of Masahiro et al. (Seiko Epson). Ink-jet inks may be either aqueous- or organic solvent-based. Aqueous inks are preferred for printing in home, office and retail environments. In addition to water and one or more colorants, such as dyes or pigments, an aqueous ink typically contains one or more humectants, which affect ink viscosity and volatility, one or more surfactants, which affect the wetting and penetrating properties of the ink, and a biocide, which extends the useful life of the ink. Aqueous inks may also contain many other ingredients, including metal ion chelating agents, pH buffers, defoamers, and dispersing agents. It is well known to improve the tone scale or bit depth of an image by using more than one ink density for each color. Representative ink-jet inks are described in, for example, U.S. Pat. No. 5,571,850 of Ma et al. (DuPont), U.S. Pat. No. 5,560,770 of Yatake (Seiko Epson), and U.S. Pat. No. 5,738,716 of Santilli et al. (Eastman Kodak). Ink-jet receivers may be reflective, transparent, or of intermediate transparency (e.g., for day/night display materials). At minimum, an ink-jet receiver includes a support and an ink receiving layer. The simplest ink-jet receiver is plain paper, in which these two functions are combined. As a practical matter, more complex receiver structures are required for improved image quality and physical properties. Specifically formulated ink receiving layers coated on paper or other supports improve color density and dot resolution. Receiver composition and structure may also be modified to improve properties such as wettability, ink absorptivity, drying time, gloss, reduced image artifacts, waterfastness, and light and dark stability. Representative ink-jet receiver structures and compositions are described in, for example, U.S. Pat. No. 4,954,395 of Hasegawa et al. (Canon), U.S. Pat. No. 5,725,961 of Ozawa et al. (Seiko Epson), and U.S. Pat. No. 5,605,750 of Romano et al. (Eastman Kodak).

The present invention is illustrated by the following Examples.

EXAMPLES

Characterization of Polymeric Materials

Glass Transition Temperature and Melting Temperature

Both glass transition temperature (Tg) and melting temperature (Tm) of the dry polymer material were determined by differential scanning calorimetry (DSC), using a ramping rate of 20 C./minute. Tg is defined herein as the inflection point of the glass transition and Tm is defined herein as the peak of the melting transition.

Particle Size Measurement

All particles were characterized by Photon Correlation Spectroscopy using a Zetasizer Model DTS5100 manufactured by Malvern Instruments.

Average Molecular Weight

The samples were analyzed by size-exclusion chromatography in tetrahydrofuran using three Polymer Laboratories Plgel™mixed-C columns. The column set was calibrated with narrow-molecular-weight distribution polystyrene standards between 595 (log M=2.76) and 2170000 (log M=6.34) daltons. Number average molecular weight and polydispersity (defined as the ratio of weight average molecular weight and number average molecular weight) were reported.

Polymer Preparation

C1 (comparative polymer)

This material is high density polyethylene in the aqueous dispersion form, purchased from SC Johnson under the trade name Jonwax™ 26. The number average molecular weight of polyethylene is 7100. The average particle size of dispersion is 50 nm and Tm is 130° C. The aqueous dispersion was dialyzed against distilled water for 16 hours using membrane with molecular weight cutoff of 20,000 to remove excess surfactants and salts.

P1 (Polymer of the Invention)

This polystyrene sample was purchased from Aldrich Chemical Company, Inc. by the catalogue number 33165-1. Number average molecular weight is 1610, polydispersity is 31.3, Tg=55° C. A colloidal dispersion of this material in gelatin was prepared following the procedure described in the next section subtitled "Dispersion Preparation".

P2 (Polymer of the Invention: Low Molecular Weight Polystyrene Homopolymer)

The following agents were weighed into a two-neck air-free round bottom flask equipped with a condenser and magnetic stirring bar under ambient atmosphere: 250 g of styrene, 37 g of 1-phenylethyl bromide (initiator), 28.6 g of CuBr (catalyst), and 62.4 g of 2,2'-dipyridyl (ligand). After purging the solution with inert nitrogen gas for 30 minutes, the flask was covered and placed in a pre-heated oil bath at 100° C. and the polymerization was carried out at that temperature for 7 hours. The polymer was first precipitated from cold methanol and then dried under vacuum at 60° C. overnight. Yield: 138 grams. The polymer was characterized by means of SEC with number average molecular weight (Mn) and polydispersity being 1,540 and 1.3, respectively. DSC showed a Tg at 61° C. A colloidal dispersion of this material in gelatin was prepared following the procedure described in the next section subtitled "Dispersion Preparation".

P3 (Polymer of the Invention: Styrene-co-n-butyl Acrylate Random Copolymer)

The following agents were weighed into a three-neck round bottom flask equipped with a condenser and magnetic stirring bar under ambient atmosphere: 240 g of styrene, 60 g of n-butyl acrylate, 1.8 g of 1-phenylethyl bromide (initiator), 1.4 g of CuBr (catalyst), and 4.5 g of 2,2'-dipyridyl (ligand). After purging the solution with inert nitrogen gas for 30 minutes, the flask was covered and placed in a pre-heated oil bath at 110° C. and the polymerization was carried out at that temperature for 20 hours. The polymer was first precipitated from methanol and then dried under vacuum at 60° C. overnight. Yield: 270 grams. The polymer was characterized by means of SEC with number average molecular weight (Mn) and polydispersity being 20,000 and 1.2, respectively. The polymer composition was determined by means of 1H NMR with styrene and n-butyl acrylate being 70% and 30%, respectively. DSC showed a Tg at 67° C. A colloidal dispersion of this material in gelatin was prepared following the procedure described in the next section subtitled "Dispersion Preparation".

P4 (Polymer of the Invention: Styrene-co-methyl Acrylate Random Copolymer)

The following agents were weighted into a two-neck air-free round bottom flask equipped with a condenser and magnetic stirring bar under ambient atmosphere: 40 g of styrene, 20 g of methyl acrylate, 1.6 g of ethyl 2 -bromoisobutyrate (initiator), 1.1 g of CuBr (catalyst), and 2.5 g of 2,2'-dipyridyl (ligand). After purging the solution with inert nitrogen gas for 30 minutes, the flask was covered and placed in a pre-heated oil bath at 100° C. and the polymerization was carried out at that temperature for 23 hours. The polymer was first precipitated from methanol and then dried under vacuum at 60° C. overnight. Yield: 47 grams. The polymer was characterized by means of SEC with number average molecular weight (Mn) and polydispersity being 7,180 and 1.2, respectively. The polymer composition was determined by means of 1H NMR with styrene and methyl acrylate being 70% and 30%, respectively. Thermal analysis showed a Tg at 70° C. A colloidal dispersion of this material in gelatin was prepared following the procedure described in the next section subtitled "Dispersion Preparation".

P5 (Polymer of the Invention: Hyperbranched Poly(styrene-co-n-butyl acrylate-co-vinylbenzyl Chloride)

The following agents were weighed into a three-neck round bottom flask equipped with a condenser and magnetic stirring bar under ambient atmosphere: 140 g of styrene, 40 g of n-butyl acrylate, 1 g of carbon tetrachloride, 0.64 g of CuCl (catalyst), and 2.8 g of 2,2'-dipyridyl (ligand). After purging the solution with inert nitrogen gas for 30 minutes, the flask was covered and placed in a pre-heated oil bath at 120° C. Then, 20 g of 4-vinylbenzyl chloride was added by means of syringe pump over 4 hours. After the polymerization was carried out at 120–130° C. for 20 hours, the polymer was first precipitated from cold methanol and then dried under vacuum at 60° C. overnight. Yield: 145 grams. The polymer was characterized by means of SEC with number average molecular weight (Mn) and polydispersity being 13,600 and 3.6, respectively. The polymer composition was determined by means of 1H NMR with styrene, n-butyl acrylate, and 4-vinylbenzyl chloride being 75%, 18%, and 7%, respectively. DSC showed a Tg at 63° C. A colloidal dispersion of this material in gelatin was prepared following the procedure described in the next section subtitled "Dispersion Preparation".

P6 (Polymer of the Invention: Polystyrene Latex)

1.25 g of Rhodacal™A-246 (by Rhone-Poulenc), 1 g of sodium persulfate, and 600 ml distilled water were mixed in a 2 L three-neck round-bottom flask equipped with a mechanical stirrer and condenser. The flask was immersed in a constant temperature bath at 80° C. and purged with nitrogen for 30 minutes. A monomer emulsion comprising 300 ml of distilled water, 1.25 g Rhodacal ™A-246L and 100 g styrene was then pumped in the reactor at such rate that the total monomer addition time was 90 min. The polymerization was continued for 20 hours. The latex was cooled to room temperature and filtered. The Z-ave particles size measured by Malvem's Zetasizer IIC was 83.6 nm. Mn measured by GPC was 33000 with polydispersity of 6.0. pH of the latex was adjusted to 4.0 with 1N NaOH. Final % solids was 9.9%. The polymer was characterized by means of SEC with number average molecular weight (Mn) and polydispersity being 33,000 and 6.0, respectively. DSC showed a Tg at 103° C. The polymer latex was introduced into the coating solution as prepared.

P7 (Polymer of the Invention: Poly(t-butyl styrene)latex)

4.5 g of Rhodacal™ A-246 and 510 ml of distilled water were mixed in a 1 L three-neck round-bottom flask equipped with a mechanical stirrer and condenser. The flask was immersed in a constant temperature bath at 70° C. and purged with nitrogen for 30 min. 90 g of styrene was added to the reactor and stirred for 3 min. 9 g of 10% sodium persulfate and 4.5 g of 10% sodium metabisulfite were added to initiate the polymerization. The polymerization was continued for three hours. 1 g each of 10% t-butyl hydroperoxide and sodium sulfoxylated formaldehyde were post-added to remove the residual monomers. The latex was cooled to room temperature, pH was adjusted to 4.0 with 1N NaOH and filtered. Particle size measured by Malvem's Zetasizer IIC was 81.1 nm and % solids was 13%. The polymer was characterized by means of SEC with number average molecular weight (Mn) and polydispersity being 13,600 and 5.4, respectively. DSC showed a Tg at 115° C. Polymer latex was introduced into the coating solution as prepared.

P8 (Polymer of the Invention: Poly(vinyl toluene)latex)

The prepation procedure was the same as P7 except that 90 g of vinyl toluene was used. The particle size was 83.5 nm and the % solids was 13.2%. The polymer was characterized by means of SEC with number average molecular weight (Mn) and polydispersity being 12,400 and 10.9, respectively. DSC showed a Tg at 92° C. Polymer latex was introduced into the coating solution as prepared.

P9 (Polymer of the Invention: Poly(styrene-co-trifluoroethylmethacrylate))

3.15 g of Rhodacal™ A-246, 0.54 g of Fluorad FX-13 and 510 ml of distilled water were mixed in a 1 L three-neck round-bottom flask equipped with a mechanical stirrer and condenser. The flask was immersed in a constant temperature bath at 70° C. and purged with nitrogen for 30 min. 63 g of styrene and 27 g of trifluoethylmethacrylate were added to the reactor and stirred for 3 min. 9 g of 10% sodium persulfate and 4.5 g of 10% sodium metabisulfite were added to initiate the polymerization. The polymerization was continued for three hours. 1 g each of 10% t-butyl hydroperoxide and sodium sulfoxylated formaldehyde were post-added to remove the residual monomers. The latex was cooled to room temperature, pH was adjusted to 4.0 with 1N NaOH and filtered. Particle size measured by Malvem's Zetasizer IIC was 81.1 nm and the % solids was 13%. The polymer was characterized by means of SEC with number average molecular weight (Mn) and polydispersity being 12,400 and 7.9, respectively. DSC showed a Tg at 86° C. Polymer latex was introduced into the coating solution as prepared.

P10 (Polymer of the Invention: Comb-type Polystyrene)

The comb polystyrene was synthesized by means of atom transfer radical polymerization using poly(vinyl benzylchloride) as macro-initiator. Poly(vinyl benzylchloride) macro-initiator was synthesized as follows. The following reactants were first mixed in a three-neck flask equipped with a condenser and magnetic stirring bar under ambient atmosphere: 185 g of vinyl benzylchloride, 14.5 grams of iodoacetonitrile (initiator), and 4.3 g of AIBN (catalyst). After purging the solution with inert nitrogen gas for 15 minutes, the flask was covered and placed in a pre-heated oil bath at 70° C. and the polymerization was carried out at that temperature for 18 hours. The polymer was first precipitated from cold methanol and then dried under vacuum at 40° C. overnight. Yield: 50 grams. The polymer was characterized by means of SEC with number average molecular weight (Mn) and polydispersity being 2,290 and 1.27, respectively.

Comb polystyrene was then synthesized as follows. The following reactants were first mixed in a three-necks flask equipped with a condenser and magnetic stirring bar under ambient atmosphere: 5 g of poly (vinyl benzylchloride) macro-initiator as synthesized above, 66 g of styrene, 0.1 g of CuCl, and 4.5 g of 2,2'-dypridyl. After purging the solution with inert nitrogen gas for 15 minutes, the flask was covered and placed in a pre-heated oil bath at 120° C. and the polymerization was carried out at that temperature for 18 hours. The polymer was first precipitated from methanol and then dried under vacuum at 40° C. overnight. Yield: 62 grams. The polymer was characterized by means of SEC with number average molecular weight (Mn) and polydispersity being 28000 and 1.84, respectively. From 1H NMR, all vinyl benzylchloride sites were consumed and the final polymer thus can be considered as a comb polystyrene. DSC showed a Tg at 63° C. A colloidal dispersion of this material in gelatin was prepared following the procedure described in the next section subtitled "Dispersion Preparation".

P11 (Polymer of the Invention: Styrene/Acrylonitrile (30/70)Latex)

4.5 g of Rhodacal™ A-246 and 510 ml of distilled water were mixed in a 1L three-neck round-bottom flask equipped with a mechanical stirrer and condenser. The flask was immersed in a constant temperature bath at 70° C. and purged with nitrogen for 30 min. 27 g of styrene and 63 g of acrylonitrile were added to the reactor and stirred for 3 min. 9 g of 10% sodium persulfate and 4.5 g of 10% sodium metabisulfite were added to initiate the polymerization. The polymerization was continued for three hours. 1 g each of 10% t-butyl hydroperoxide and sodium sulfoxylated formaldehyde were post-added to remove the residual monomers. The latex was cooled to room temperature, pH was adjusted to 4.0 with 1N NaOH and filtered. Particle size measured by Malvern's Zetasizer IIC was 95.2 nm and %solids was 13.2%. The polymer was characterized by means of SEC with number average molecular weight (Mn) and polydispersity being 124,400 and 4.34, respectively. DSC showed a Tg at 112° C. Polymer latex was introduced into the coating solution as prepared.

Dispersion Preparation 40 grams of polymer was dissolved in 160 grams of ethyl acetate, and then emulsified in a 45° C. aqueous solution containing 180 g of water, 80 g of 12.5% gelatin solution and 40 g of 10% Alkanol XC solution by passing the mixture through a colloid mill with 4–5 mil gap for 4 times. Ethyl acetate was removed by heating the emulsified dispersion under low pressure. The particle size of dispersed particles were generally about 0.14 micrometers in average diameter.

Photographic Sample Preparation

Sample 1.1 was prepared by coating in sequence blue-light sensitive layer, interlayer, green-light sensitive layer, UV layer, red-light sensitive layer, UV layer and overcoat on photographic paper support. The components in each individual layer is described below. Other samples were prepared identical to sample No. 1.1 except for different overcoat compositions.

| Layer | Laydown (mg/sq.ft.) |
|---|---|
| Overcoat | 40.0 Gelatin |
| | 1.0 SF-1 |
| | 0.39 SF-2 |
| | 8.87 Bis(vinylsulfonyl)methane |
| UV | 12.11 UV-1 |
| | 2.13 UV-2 |
| | 6.25 ST-4 |
| | 2.37 Di-butyl phthalate |
| | 2.37 1,4-Cyclohexylenedimethylene bis(2-ethylhexanoate) |
| | 47.7 Gelatin |

-continued

| Layer | Laydown (mg/sq.ft.) |
|---|---|
| Cyan | 16.2 Red-light sensitive AgX |
| | 39.31 C-1 |
| | 38.52 di-butyl phthalate |
| | 3.22 Tri-cresyl phosphate |
| | 25.31 UV-1 |
| | 126.6 Gelatin |
| | 0.5 Silver phenyl mercaptotetrazole |
| UV | 17.43 UV-1 |
| | 3.07 UV-1 |
| | 9.00 ST-4 |
| | 3.41 Di-butyl phthalate |
| | 3.41 1,4-Cyclohexylenedimethylene bis(2-ethylhexanoate) |
| | 68.6 Gelatin |
| Magenta | 7.70 Green-light sensitive AgX |
| | 1.11 Potassium chloride |
| | 29.5 M-1 |
| | 8.26 Di-butyl phthalate |
| | 3.54 S-4 |
| | 17.7 ST-21 |
| | 2.01 ST-20 |
| | 57.0 ST-22 |
| | 0.05 1-Phenyl-5-mercaptotetrazole |
| | 0.285 Nitric acid |
| | 117 Gelatin |
| Interlayer | 10.0 ST-4 |
| | 17.38 Di-butyl phthalate |
| | 6.0 Disulfocatechol disodium |
| | 0.524 Nitric acid |
| | 0.18 SF-1 |
| | 70.0 Gelatin |
| Yellow | 25.0 Blue-light sensitive AgX |
| | 60.0 Y-1 |
| | 26.3 S-4 |
| | 0.88 ST-16 |
| | 0.23 Dye-4 |
| | 0.012 1-Phenyl-5-mercaptotetrazole |
| | 124.1 Gelatin |
| Photographic paper support: | |
| Sublayer 1 | resin coat (Titanox and optical brightener in polyethylene) |
| Sublayer 2 | paper |
| Sublayer 3 | resin coat (polyethylene) |

Testing Photographic Samples

Test for Water Resistance

Ponceau Red dye is known to stain gelatin through the ionic interaction, therefore is used here to test water resistance. Ponceau red dye solution was prepared by dissolving 1 gram dye in 1000 grams mixture of acetic acid and water (5 parts: 95 parts). The water permeability was done by soaking fused samples in the dye solution for 5 minutes followed by a 30-second water rinse to removed excess dye solution on the coating surface. Each sample was then air dried, and status A reflectance green density on the soaked area was recorded. The high optical density of 3 is an indication of completely water permeable coating, such as sample No. 1, its water resistance=0%. Relative to density of 3 (sample No.1) being 0% water resistance and density of 0 being 100% water resistant, the percent water resistance is calculated by the following equation.

$$\% \text{ water resistance}=[1-(\text{status A density}/3)]\times 100$$

Lowest Fusing Temperature

Samples without being exposed to light were processed through Kodak RA4 process to obtain white Dmin samples. These processed samples were then passed through a set of heated pressurized rollers (fusing) at various temperatures. These samples were then tested by Ponceau Red dye solution as described above to determine water resistance. The lowest fusing temperature is reported for which samples turned into water impermeable when fused at or above such temperature.

Test for Dry Scratch Resistance

Each sample was rubbed with a dry paper towel for 8 passes under a pressure of 0.75 psi (500 grams over a 1.375-inch diameter area). The scratches generated by the rubbing test were observed and reported.

Example 1

The following samples were prepared and tested for fusibility, water resistance before and after fusing, and scratch resistance.

TABLE 1

| Sample ID | Overcoat Composition (in mg/sq.ft.) | Note | % water resistance prior to fusing | Lowest Fusing Temperature (F) | % water resistance after fusing | Dry scratch resistance (rating) |
|---|---|---|---|---|---|---|
| 1.1 | | comparison | 0% | | 0% | A* |
| 1.2 | As 1.1 + 160 Jonwax ™ 26 | comparison | 0% | 300 | 96% | B** |
| 1.3 | As 1.1 + 130 Jonwax ™ 26 | comparison | 0% | 300 | 96% | B** |
| 1.4 | As 1.1 + 160 P1 | invention | 0% | 310 | 95% | A* |
| 1.5 | As 1.1 + 140 P1 | invention | 0% | 320 | 94% | N.A. |
| 1.6 | As 1.1 + 120 P1 | invention | 0% | 320 | 94% | N.A. |
| 1.7 | As 1.1 + 160 P2 | invention | 0% | 310 | 96% | A* |
| 1.8 | As 1.1 + 160 P3 | invention | 0% | 310 | 96% | A* |
| 1.9 | As 1.1 + 160 P4 | invention | 0% | 310 | 96% | N.A. |
| 1.10 | As 1.1 + 160 P5 | invention | 0% | 310 | 96% | N.A. |
| 1.11 | As 1.1 + 160 P6 | invention | 0% | 320 | 96% | N.A. |
| 1.12 | As 1.1 + 160 P7 | invention | 0% | 340 | 88% | A* |
| 1.13 | As 1.1 + 160 P8 | invention | 0% | 320 | 93% | A* |
| 1.14 | As 1.1 + 160 P9 | invention | 0% | 320 | 95% | A* |
| 1.15 | As 1.1 + 160 P10 | invention | 0% | 340 | 93% | A* |
| 1.16 | As 1.1 + 160 P11 | invention | 0% | 340 | 91% | N.A. |

*: A = several light scratches were observed.
**: B = numerous dense and heavy scratches were observed.

For comparison, sample 1.1 did not contain any fusible polymer in the overcoat and therefore did not exhibit any water resistance after being fused. Samples 1.2 through 1.16 showed 0% water resistance prior to fusing, which indicates processing solutions are free to diffuse through the overcoat layer of this invention to generate images. Samples 1.2 and 1.3 contained high density polyethylene particles in the overcoat, as described in U.S. Pat. No. 5,856,051, and showed water resistance after being fused, but inferior scratch resistance regardless of the amount of Jonwax 26 polyethylene particles. Samples 1.4 through 1.16 contained particles of this invention in the overcoat. Samples 1.4 through 1.16 exhibited water resistance and improved dry scratch resistance after being fused, compared to samples 1.2 and 1.3.

Example 2

Sample 2.1 was prepared as described below.

Blue Sensitive Emulsion (Blue EM-1).

A high chloride silver halide emulsion is precipitated by adding approximately equimolar silver nitrate and sodium chloride solutions into a well stirred reactor containing glutaryldiaminophenyldisulfide, gelatin peptizer and thioether ripener. Cesium pentachloronitrosylosmate(II) dopant is added during the silver halide grain formation for most of the precipitation, followed by the addition of potassium hexacyanoruthenate(II), potassium (5-methylthiazole)-pentachloroiridate, a small amount of KI solution, and shelling without any dopant. The resultant emulsion contains cubic shaped grains having edge length of 0.6 $\mu$m. The emulsion is optimally sensitized by the addition of a colloidal suspension of aurous sulfide and heat ramped to 60° C. during which time blue sensitizing dye BSD-4, potassium hexchloroiridate, Lippmann bromide and 1-(3-acetamidophenyl)-5-mercaptotetrazole were added.

Green Sensitive Emulsion (Green EM-1)

A high chloride silver halide emulsion is precipitated by adding approximately equimolar silver nitrate and sodium chloride solutions into a well stirred reactor containing, gelatin peptizer and thioether ripener. Cesium pentachloronitrosylosmate(II) dopant is added during the silver halide grain formation for most of the precipitation, followed by the addition of potassium (5-methylthiazole)-pentachloroiridate. The resultant emulsion contains cubic shaped grains of 0.3 $\mu$m in edgelength size. The emulsion is optimally sensitized by the addition of glutaryldiaminophenyldisulfide, a colloidal suspension of aurous sulfide and heat ramped to 55° C. during which time potassium hexachloroiridate doped Lippmann bromide, a liquid crystalline suspension of green sensitizing dye GSD-1, and 1-(3-acetamidophenyl)-5-mercaptotetrazole were added.

Red Sensitive Emulsion (Red EM-1)

A high chloride silver halide emulsion is precipitated by adding approximately equimolar silver nitrate and sodium chloride solutions into a well stirred reactor containing gelatin peptizer and thioether ripener. During the silver halide grain formation, potassium hexacyanoruthenate(II) and potassium (5-methylthiazole)-pentachloroiridate are added. The resultant emulsion contains cubic shaped grains of 0.4 $\mu$m in edgelength size. The emulsion is optimally sensitized by the addition of glutaryldiaminophenyldisulfide, sodium thiosulfate, tripotassium bis{2-[3-(2-sulfobenzamido)phenyl]-mercaptotetrazole} gold(I) and heat ramped to 64° C. during which time 1-(3-acetamidophenyl)-5-mercaptotetrazole, potassium hexachloroiridate, and potassium bromide are added. The emulsion is then cooled to 40° C., pH adjusted to 6.0 and red sensitizing dye RSD-1 is added.

Coupler dispersions were emulsified by methods well known in the art. The following imaging layers were coated in sequence on polyethylene-laminated photographic paper.

| Layer | Item | Laydown (mg/ft$^2$) |
|---|---|---|
| Layer 1 | Blue Sensitive Layer | |
| | Gelatin | 122.0 |
| | Blue sensitive silver (Blue EM-1) | 22.29 |
| | Y-4 | 38.49 |
| | ST-23 | 44.98 |
| | Tributyl Citrate | 20.24 |
| | ST-24 | 11.25 |
| | ST-16 | 0.883 |
| | Sodium Phenylmercaptotetrazole | 0.009 |
| | Piperidino hexose reductone | 0.2229 |
| | 5-chloro-2-methyl-4-isothiazolin-3-one/2-methyl-4-isothiazolin-3-one(3/1) | 0.019 |
| | SF-1 | 3.40 |
| | Potassium chloride | 1.895 |
| | Dye-1 | 1.375 |
| Layer 2 | Interlayer | |
| | Gelatin | 69.97 |
| | ST-4 | 9.996 |
| | S-4 | 18.29 |
| | 5-chloro-2-methyl-4-isothiazolin-3-one/2-methyl-4-isothiazolin-3-one(3/1) | 0.009 |
| | Catechol disulfonate | 3.001 |
| | SF-1 | 0.753 |
| Layer 3 | Green Sensitive Layer | |
| | Gelatin | 110.96 |
| | Green sensitive silver (Green EM-1) | 9.392 |
| | M-4 | 19.29 |
| | Oleyl Alcohol | 20.20 |
| | S-4 | 10.40 |
| | ST-21 | 3.698 |
| | ST-22 | 26.39 |
| | Dye-2 | 0.678 |
| | 5-chloro-2-methyl-4-isothiazolin-3-one/2-methyl-4-isothiazolin-3-one(3/1) | 0.009 |
| | SF-1 | 2.192 |
| | Potassium chloride | 1.895 |
| | Sodium Phenylmercaptotetrazole | 0.065 |
| Layer 4 | M/C Interlayer | |
| | Gelatin | 69.97 |
| | ST-4 | 9.996 |
| | S-4 | 18.29 |
| | Acrylamide/t-Butylacrylamide sulfonate copolymer | 5.026 |
| | Bis-vinylsulfonylmethane | 12.91 |
| | 3,5-Dinitrobenzoic acid | 0.009 |
| | Citric acid | 0.065 |
| | Catechol disulfonate | 3.001 |
| | 5-chloro-2-methyl-4-isothiazolin-3-one/2-methyl-4-isothiazolin-3-one(3/1) | 0.009 |
| Layer 5 | Red Sensitive Layer | |
| | Gelatin | 125.96 |
| | Red Sensitive silver (Red EM-1) | 17.49 |
| | IC-35 | 21.59 |
| | IC-36 | 2.397 |
| | UV-1 | 32.99 |
| | Dibutyl sebacate | 40.49 |
| | S-6 | 13.50 |
| | Dye-3 | 2.127 |
| | Potassium p-toluenethiosulfonate | 0.242 |
| | 5-chloro-2-methyl-4-isothiazolin-3-one/2-methyl-4-isothiazolin-3-one(3/1) | 0.009 |
| | Sodium Phenylmercaptotetrazole | 0.046 |
| | SF-1 | 4.868 |
| Layer 6 | UV Overcoat | |
| | Gelatin | 76.47 |
| | UV-2 | 3.298 |
| | UV-1 | 18.896 |
| | ST-4 | 6.085 |
| | SF-1 | 1.162 |
| | S-6 | 7.404 |
| | 5-chloro-2-methyl-4-isothiazolin-3-one/2-methyl-4-isothiazolin-3-one(3/1) | 0.009 |
| Layer 7 | SOC | |
| | Gelatin | 59.98 |
| | Ludox AM ™ (colloidal silica) | 14.99 |
| | Polydimethylsiloxane (DC200 ™) | 1.877 |

-continued
| Layer | Item | Laydown (mg/ft$^2$) |
|---|---|---|
| | 5-chloro-2-methyl-4-isothiazolin-3-one/2-methyl-4-isothiazolin-3-one(3/1) | 0.009 |
| | SF-2 | 0.297 |
| | Tergitol 15-S-5 ™ (surfactant) | 0.186 |
| | SF-1 | 0.753 |
| | Aerosol OT ™ (surfactant) | 0.269 |
IC-35
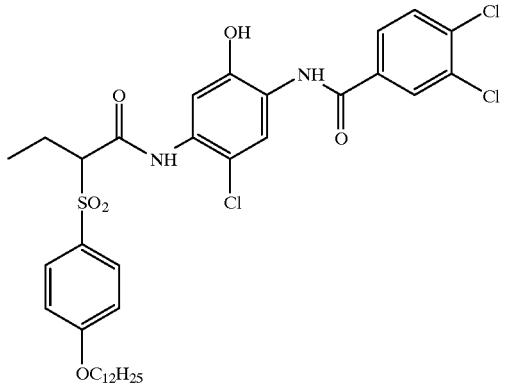
IC-36
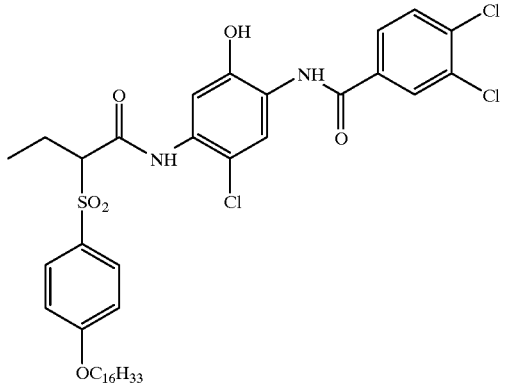
C-1
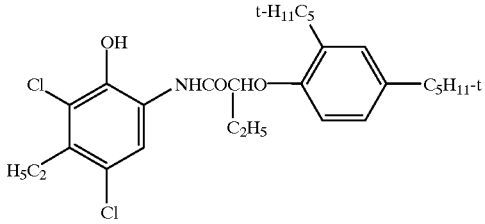
M-1
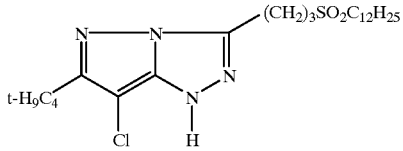
M-4
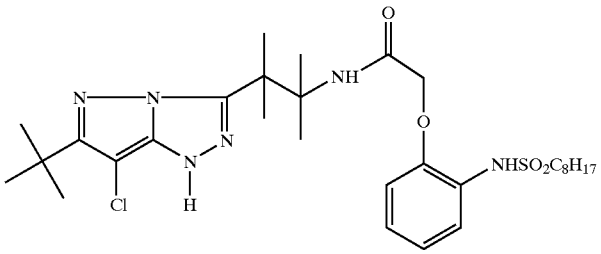

-continued
| Layer | Item | Laydown (mg/ft$^2$) |
|---|---|---|
| | 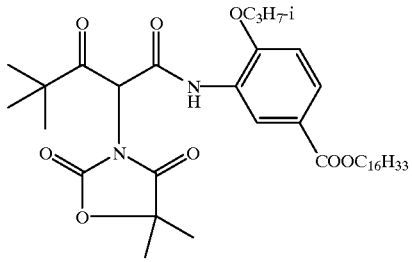 | Y-1 |
| | 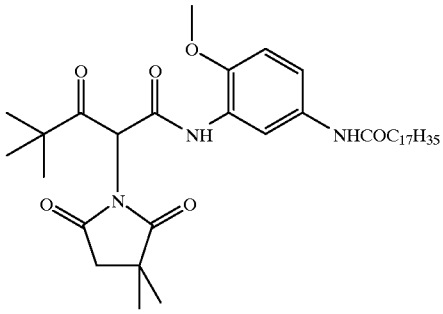 | Y-4 |
| | 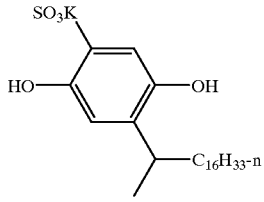 | ST-16 |
| | 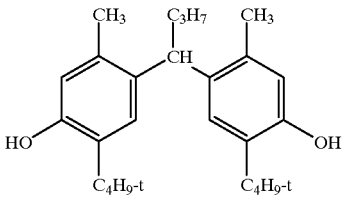 | ST-20 |
| | 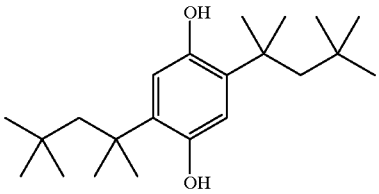 | ST-4 |
| | ST-21 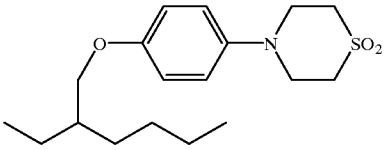 | ST-22 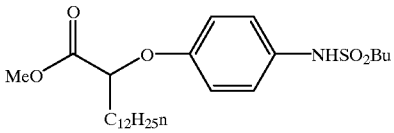 |

-continued
| Layer | Item | Laydown (mg/ft$^2$) |
|---|---|---|
| 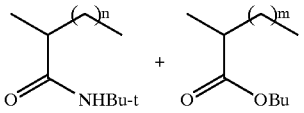 n:m = 1:1; MW = 75,000–100,000 | ST-23 | 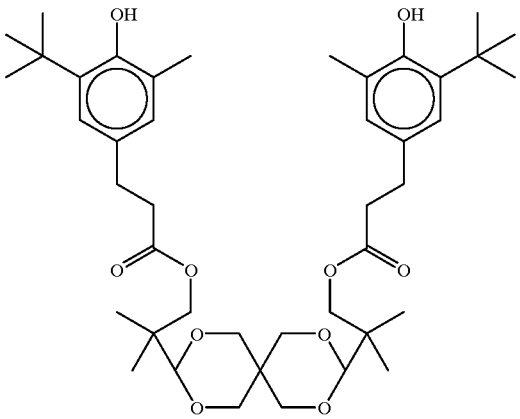 ST-24 |
| 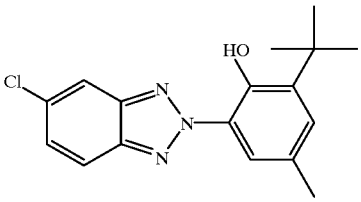 UV-1 | | 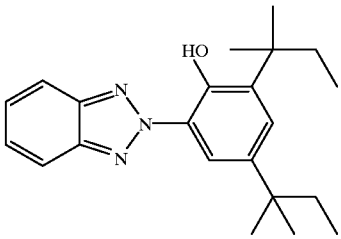 UV-2 |
| 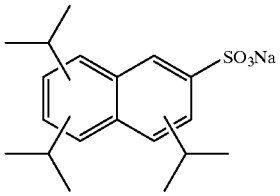 SF-1 | | $CF_3.(CF_2)_7.SO_3Na$ SF-2 |
| S-4 = Diundecyl phthalate<br>S-6 = Tris(2-ethylhexyl)phosphate | | 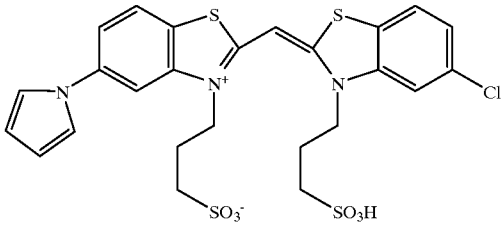 BSD-4 |
| | | 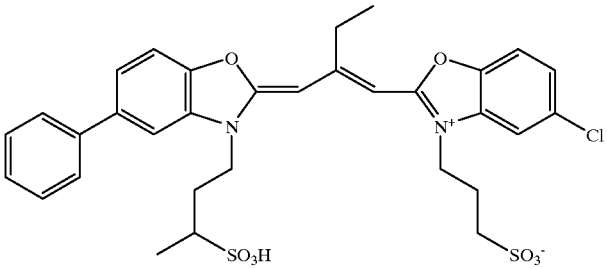 GSD-1 |

-continued
| Layer | Item | Laydown (mg/ft$^2$) |
|---|---|---|
| | 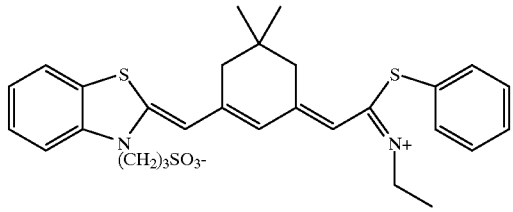 | RSD-1 |
| | 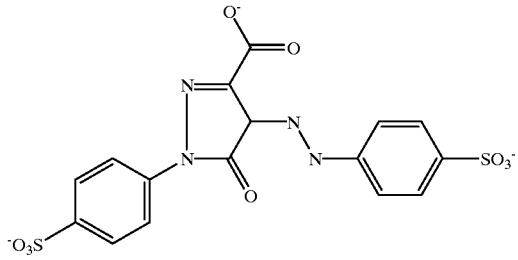 | DYE-1 |
| | 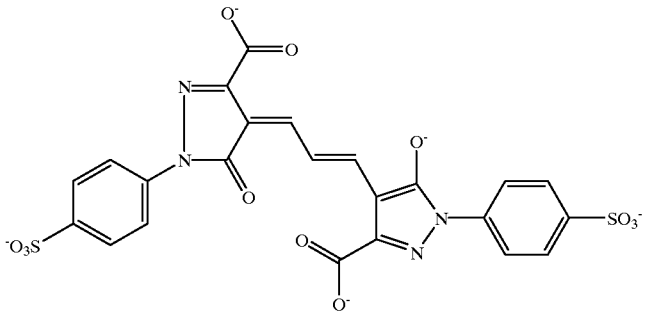 | DYE-2 |
| | 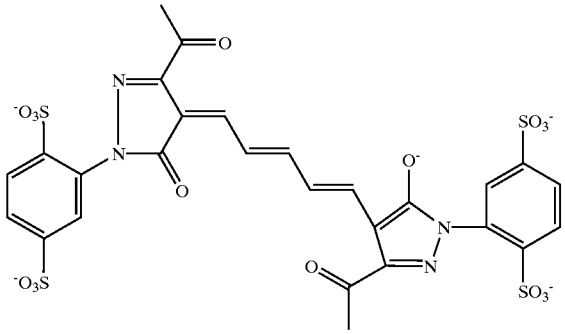 | DYE-3 |
| | 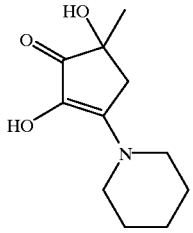 | DYE-4 |
Sample 2.2 of this invention was prepared identical to sample 2.1 except replacing 60 mg/sq.ft. of gelatin with 40 mg/sq.ft. gelatin and 160 mg/sq.ft. of P6 in the overcoat. Both samples were tested for fusibility, water resistance before and after fusing, and scratch resistance.

TABLE 2

| Sample ID | Overcoat Composition (in mg/sq.ft.) | Note | % water resistance prior to fusing | Lowest Fusing Temperature (° F.) | % water resistance after fusing | Dry scratch resistance (rating) |
|---|---|---|---|---|---|---|
| 2.1 | 60 gel | comparison | 0% | | 0% | A* |
| 2.2 | 40 gel + 160 P6 | invention | 0% | 330 | 96% | A* |

*: A = several light scratches were observed.

As shown in Table 2, the overcoat of this invention is able to provide developability for imaging layers before fusing and water resistance after fusing, with acceptable dry scratch resistance as in Example 1, regardless of changes in imaging layers.

Example 3

Sample 3.1 was prepared identically to Sample 2.1 except the paper support used was biaxially oriented support consisting of a paper base and a biaxially oriented polypropylene sheet laminated to both sides of the paper base. Sample 3.2 was prepared identically to sample 3.1, except for replacing 60 mg/sq.ft. of gelatin with 40 mg/sq.ft. of gelatin and 160 mg/sq.ft. of P6 in the overcoat. Both samples were tested for fusibility, water resistance before and after fusing, and scratch resistance.

TABLE 3

| Sample ID | Overcoat Composition (in mg/sq.ft.) | Note | % water resistance prior to fusing | Lowest Fusing Temperature (° F.) | % water resistance after fusing | Dry scratch resistance (rating) |
|---|---|---|---|---|---|---|
| 3.1 | 60 gel | comparison | 0% | | 0% | A* |
| 3.2 | 40 gel + 160 P6 | invention | 0% | 330 | 97% | A* |

*: A = several light scratches were observed.

As shown in Table 3, the overcoat of this invention is able to provide developability for imaging layers before fusing and water resistance after fusing, with acceptable dry scratch resistance as in Examples 1 and 2, regardless of changes in imaging layers and the paper support.

Example 4

Sample 4.1 represents a gelatin-based ink-jet receiver material. Sample 4.2 has the novel overcoat of this invention with 200 mg/sq.ft. of gelatin and 600 mg/sq.ft. of P6 in the overcoat. The corresponding fusibility, water resistance before and after fusing, and scratch resistance are shown in Table 4.

TABLE 4

| Sample ID | Overcoat Composition (in mg/sq.ft.) | Note | % water resistance prior to fusing | Lowest Fusing Temperature (° F.) | % water resistance after fusing | Dry scratch resistance (rating) |
|---|---|---|---|---|---|---|
| 4.1 | None | Comparison | 0% | | 0% | A* |
| 4.2 | 200 gel + 600 P6 | invention | 0% | 330 | 97% | A* |

*: A = several light scratches were observed.

For ink-jet receiver materials, the overcoat of this invention is able to provide for passage of ink into the ink-receiving layer before fusing and water resistance after fusing, with acceptable dry scratch resistance as in Examples 1 through 3.

The invention has been described in detail with particular reference to certain preferred embodiments thereof, but it will be understood that variations and modifications can be effected within the spirit and scope of the invention.

What is claimed is:

1. An image recording element having a protective overcoat thereon, the protective overcoat formed by the steps of:

providing an image recording element having at least one silver-based light-sensitive emulsion layer;

applying to the at least one silver-based light-sensitive emulsion layer an aqueous overcoat composition comprising 30 to 95 weight percent, based on the dry laydown of the overcoat, of hydrophobic polymer particles having an average size of 0.01 to 0.5 micrometers, said hydrophobic polymer being a homopolymer of the monomer described in Structure 1 or a copolymer containing at least 30 percent by weight, based on total weight of monomers, of the monomer described in Structure 1 and 5 to 70 weight percent of crosslinked gelatin, based on the dry laydown of the overcoat, said hydrophobic polymer exhibiting a glass transition temperature, but not a melting point;

processing the at least one silver-based light sensitive emulsion layer to provide an imageed recoridng element; and subjecting the hydrophobic polymer particles to provide the imaged recording element to fusing, including the application of pressure and heat to the image recording element, at a temperature higher than 300° F. to provide a photographic element having a protective overcoat:

Structure 1

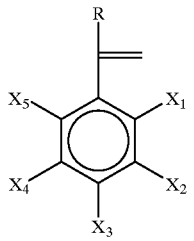

wherein:

R is H, $CH_3$, $C_2H_5$, or $C_3H_7$; and $X_1$, $X_2$, $X_3$, $X_4$ and $X_5$ are H, F, Cl, Br, I, CN, $CH_3O$, $C_2H_5O$, $C_3H_7O$, $C_4H_9O$, $CH_3$, $C_2H_5$, $C_3H_7$, n-$C_4H_9$, sec-$C_4H_9$, tert-$C_4H_9$, $CF_3$, $C_2F_5$, $C_3F_7$, iso-$C_3F_7$, n-$C_4F_9$, sec-$C_4F_9$, tert-$C_4F_9$, $CH_3NH$, $(CH_3)_2N$, n-$C_5H_{11}$, $C_4H_9$, n-$C_6H_{13}$, n-$C_7H_{15}$, n-$C_8H_{17}$, n-$C_9H_{19}$, n-$C_{10}H_{21}$, or n-$C_{12}H_{25}$.

2. The imaging element of claim 1 further comprising an antistatic layer superposed on the support.

3. The imaging element of claim 1 further comprising a transparent magnetic layer superposed on the support.

4. The imaging element of claim 1 wherein the support is transparent.

5. The imaging element of claim 1 wherein the support is reflective.

6. The image recording element of claim 1 wherein the at least one silver-based light sensitive emulsion layer is applied simultaneously with applying the overcoat composition.

* * * * *